252-99 AU 165 EX
5/25/76 OR 3,959,163

United States Patent [19]

Farley

[11] 3,959,163

[45] May 25, 1976

[54] STAIN REMOVAL

[75] Inventor: George Thomas Farley, Piscataway, N.J.

[73] Assignee: Colgate-Palmolive Company, New York, N.Y.

[22] Filed: Sept. 18, 1972

[21] Appl. No.: 289,647

[52] U.S. Cl. ..... 252/99; 8/111; 252/94; 252/95; 427/220

[51] Int. Cl.[2] ..... C11D 7/38

[58] Field of Search ..... 8/111; 252/94, 95, 99; 117/100 A

[56] References Cited

UNITED STATES PATENTS

| | | | |
|---|---|---|---|
| 3,494,786 | 2/1970 | Nielson | 117/100 A |
| 3,494,787 | 2/1970 | Lund et al. | 117/100 A |
| 3,639,285 | 2/1972 | Nielson | 8/111 X |

FOREIGN PATENTS OR APPLICATIONS

| | | | |
|---|---|---|---|
| 560,389 | 9/1957 | Belgium | 260/502 R |

*Primary Examiner*—Mayer Weinblatt
*Attorney, Agent, or Firm*—John J. Tomaszewski; Murray M. Grill; Herbert S. Sylvester

[57] ABSTRACT

A stain removing composition containing diperisophthalic acid and a nonionic detergent:

6 Claims, No Drawings

STAIN REMOVAL

One aspect of this invention relates to a composition, particularly suitable for use in cool water, containing diperisophthalic acid ("DIPA") and a nonionic detergent which is a monoethylene glycol ether of a long chain alkanol. It has been found, unexpectedly, that the bleaching action of the diperisophthalic acid is enhanced, synergistically, by the presence of the nonionic detergent.

As compared to conventional chlorine bleaches, for instance, the compositon makes possible superior cleaning and stain removal without the use of substantial proportions of phosphates, without objectionable odor in the composition or in the washing vehicle or in the washed or bleached clothes, and with significant reduction in the microorganism content of the washed or bleached clothes and with greatly reduced danger of fabric damage or discoloration.

A particularly useful form of the DIPA is the stabilized material containing an alkali metal or alkaline earth metal salt of a highly ionized acid, such as the sulfate, and especially the material encapsulated with a hydrated salt all as described in Lund and Nielsen U.S. Pat. No. 3,494,787 and Nielsen U.S. Pat. No. 3,494,786, both issued Feb. 10, 1970. A product of this type is sold under the name "Suprox" and is described in a 39 page bulletin entitled "Suprox Active-Oxygen Bleach" issued May 1970 by the Commercial Development Department, PPG Industries Industrial Chemical Division. These patents and bulletin mention that the encapsulated DIPA may be mixed with detergent formulations such as heavy-duty household laundering products.

Another patent describing stabilized percarboxylic acids and admixtures thereof with synthetic detergents is French No. 1,181,892.

The following Examples are given to illustrate this invention further. In this application all parts are by weight unless otherwise indicated. In the Examples, the pressure is atmospheric unless otherwise indicated.

EXAMPLE 1

The effect of various compositions on the removal of soil from fabric in cool water (70°F) is tested Tergo- Tometer. In each test four 4 × 6 inch swatches of cotton fabric uniformly soiled with a standard research clay soil (Bandy black clay, supplied by H. C. Spinks Clay, Inc.) are agitated in the TergoTometer for 10 minutes in one liter of the cool water containing the ingredients specified below, after which the fabric swatches are withdrawn and rinsed by agitating them in a liter of cool (70°F) water for 5 minutes. The effectiveness of the composition is determined by reflectance readings ("Rd") on the fabrics before and after washing, using a Gardner Color Difference Meter for the measurement. The difference in reflectance before and after the washing is reported as "Δ Rd".

The water used is a mixture of distilled water, $CaCl_2$ and $MgCl_2$, the latter ingredients being present in amounts to provide 36 ppm of Ca ion and 14.6 ppm of Mg ion in the water so that the total hardness is 150 ppm when expressed, in conventional maner, as ppm of calcium carbonate.

The results are given in Table I below.

It will be seen that the runs are made in sets of four and that, to provide a standard of comparison, each such set includes one experiment in which the added ingredients are those of a "Control". In each case the "Control" is a standard heavy duty high performance phosphate-containing detergent composition comprising 10% sodium linear alkylbenzenesulfonate ("LAS"), 2% nonionic detergent, 2% soap, 35% pentasodium tripolyphosphate, and 7% sodium silicate ($Na_2O:SiO_2$ ration 1:2.35), 0.5% sodium carboxymethyl cellulose, and the balance sodium sulfate and water.

The diperisophthalic acid ("DIPA") is supplied in the form of "Suprox" which contains 25% of such acid encapsulated in hydrated magnesium sulfate. The figures below for the amount of DIPA are calculated by multiplying the amount of Suprox present by 0.25.

The nonionic detergent used is Shell "Neodol 45-11" which is a primary alkanol of an average of 15 to 15 carbon atoms ethoxylated with an average of 11 mols of ethylene oxide per mol of alkanol. The LAS employed in the DIPA-containing compositions is sodium linear tridecyl benzenesulfonate.

The sodium silicate has a $Na_2O:SiO_2$ ratio of 1:2.35. The sodium carbonate is anhydrous.

TABLE I

| | Milligrams of ingredient per liter of water in wash solution | | | | | | ΔRd | pH | |
|---|---|---|---|---|---|---|---|---|---|
| Expt | DIPA | Nonionic | LAS | $Na_2CO_3$ | Sodium Silicate | Control | | Initial | Final |
| A1 | 150 | 0 | 450 | 150 | 150 | 0 | 9.05 | 9.65 | 9.16 |
| A2 | 300 | 0 | 450 | 150 | 0 | 10.23 | 9.28 | 8.12 | |
| A3 | 450 | 0 | 450 | 150 | 150 | 0 | 11.33 | 8.56 | 7.66 |
| A4 | | | | | | 1500 | 9.20 | 10.08 | 9.75 |
| B1 | 150 | 450 | 0 | 150 | 150 | 0 | 12.9 | 9.79 | 9.21 |
| B2 | 300 | 450 | 0 | 150 | 150 | 0 | 14.9 | 9.55 | 7.83 |
| B3 | 450 | 450 | 0 | 150 | 150 | 0 | 14.8 | 8.87 | 7.48 |
| B4 | | | | | | 1500 | 9.8 | 10.12 | 9.78 |
| C1 | 150 | 150 | 0 | 150 | 150 | 0 | 12.0 | 9.91 | 9.30 |
| C2 | 150 | 300 | 0 | 150 | 150 | 0 | 11.8 | 9.85 | 9.25 |
| C3 | 150 | 450 | 0 | 150 | 150 | 0 | 11.4 | 9.77 | 9.18 |
| C4 | | | | | | 1500 | 9.6 | 10.14 | 9.85 |
| D1 | 150 | 150 | 75 | 150 | 150 | 0 | 10.5 | 9.80 | 9.19 |
| D2 | 150 | 150 | 150 | 150 | 150 | 0 | 11.1 | 9.86 | 9.28 |
| D3 | 150 | 150 | 225 | 150 | 150 | 0 | 11.2 | 9.82 | 9.31 |
| D4 | | | | | | 1500 | 9.4 | 10.11 | 9.85 |
| E1 | 80 | 150 | 0 | 150 | 150 | 0 | 10.0 | 10.15 | 9.84 |
| E2 | 100 | 150 | 0 | 150 | 150 | 0 | 11.7 | 9.95 | 9.46 |
| E3 | 150 | 150 | 0 | 150 | 150 | 0 | 12.3 | 9.92 | 8.96 |
| E4 | | | | | | 1500 | 10.0 | 10.02 | 9.66 |
| F1 | 300 | 0 | 0 | 150 | 150 | 0 | 9.4 | 9.46 | 7.73 |
| F2 | 0 | 300 | 0 | 150 | 150 | 0 | 8.6 | 10.33 | 10.23 |
| F3 | 150 | 150 | 0 | 150 | 150 | 0 | 11.5 | 9.80 | 9.05 |

TABLE I-continued

| Expt | Milligrams of ingredient per liter of water in wash solution DIPA | Nonionic | LAS | $Na_2CO_3$ | Sodium Silicate | Control | ΔRd | pH Initial | Final |
|---|---|---|---|---|---|---|---|---|---|
| F4 | | | | | | 1500 | 7.8 | 9.98 | 9.63 |
| G1 | 0 | 300 | 0 | 0 | 0 | 0 | 8.33 | about 7 | |
| G2 | 150 | 0 | 0 | 0 | 0 | 0 | 5.53 | about 4 | |
| G3 | 150 | 150 | 0 | 0 | 0 | 0 | 9.85 | about 4 | |
| G4 | | | | | | 1500 | 8.25 | | |

EXAMPLE 2

A composition suitable as a cool water detergent bleach for stained textile fabrics contains 10% of the nonionic detergent of Example 1; an amount of "Suprox" sufficient to provide 3.3% DIPA, 10% sodium carbonate; 10% sodium silicate ($Na_2O:SiO_2$ ratio 1:2.35); 0.5% sodium carboxymethylcellulose and a small amount (such as 0.1 to 0.4%, e.g. 0.2 or 0.3%) of a bleachstable fluorescent brightener, such as 4,4'-bis (4-phenyl-2H-1, 2, 3-triazol-2yl)-2,2'-stilbene disulfonic acid or a salt thereof (e.g. an alkali metal, particularly potassium, salt).

EXAMPLE 3

A composition, suitable as a bleach additive to the wash water in the washing of clothes in a household automatic washing machine, contains 10% of the nonionic detergent of Example 1, 10% Supprox, 10% sodium carbonate, 10% of the sodium silicate of Example 1, and the balance sodium sulfate and a small amount of moisture. This composition may be added to the wash water, in the manner conventionally employed for household bleaches, e.g. at the beginning of the wash cycle and together with the conventional detergent washing composition (such as the standard heavy duty detergent composition mentioned in Example 1). It is preferably added in amount to supply in the range of about 0.01 to 0.05% DIPA in the cool wash water, such as 10 grams of DIPA per 57 liters of wash water.

The nonionic detergent used in the present invention is preferably a monoether of a polyethylene glycol and a long chain alkanol in which the alkanol has about 10 to 16 carbon atoms and the polyethylene glycol has about 5 to 15 oxyethylene units. Such monoethers of polyethylene glycol are generally made by reacting the alkanol with ethylene oxide. Preferably the proportion of ethylene oxide is in the range of about 60 to 65%. A particularly suitable product is made by reacting 11 mols of ethylene oxide and 1 mol of a mixture of C14 and C15 straight chain normal primary alkanols, said mixture having an average of 14-15 (e.g. about 14.5) carbon atoms, which product is sold under the name "Neodol 4511". Or one may use another otherwise identical product in which said mol ratio is 13:1 instead of 11:1 ("Neodol 4513") or a similar product such as an adduct of seven mols of ethylene oxide and one mol of a mixture of alkanols of 12 to 15 carbon atoms ("Neodol 25-7"). Another nonionic detergent is an ether of polyethylene glycol and a blend of C16-C18 alcohols, containing about 60% or 65% ethylene oxide ("Alfonic 1618-60" or "Alfonic 1618-65"). Still another nonionic detergent is a condensation product of long chain alkanol, propylene oxide and ethylene oxide known as Plurafac B26.

The relative proportions of DIPA and nonionic detergent are generally in the range of about 0.2: to 1:1, preferably about 0.2:1 to 0.5:1.

The composition also preferably contains an agent which supplies sufficient alkalinity to prevent the bleaching solution from becoming unduly acidic. Examples of such materials are sodium carbonate, sodium bicarbonate, sodium silicate (e.g. of $Na_2O:SiO_2$ ratio of about 1:2 to 1:2.4); they are used, generally, in amount sufficient to make the solution initially alkaline (e.g. pH about 9 or more) but preferably not over pH 11, (as when the composition is dissolved in enough water to provide 1 liter per 150 mg of DIPA).

The compositions of this invention may also contain optical brighteners; antiredeposition agents, such as sodium carboxymethylcellulose or polyvinyl alcohol, (e.g. in proportions of about ½ to 1%); and other additives (e.g. other detergents such as alkyl benzene sulfonates having 10 to 15 carbon atoms in the alkyl chain, or olefin sulfonates of 10–20 carbon atoms) or diluents. The compositions are preferably in dry granular form having moisture contents of less than about 10%, e.g. in the range of about 2 to 8%. The compositions may be prepared simply, e.g. by dry-blending the ingredients.

The fluorescent brighteners may be of one or more well known types; thus they may be cumarin types as illustrated in U.S. Pat. Nos. 2,590,485, 2,600,375, 2,610,152, 2,647,132, 2,647,133, 1,791,564, and 2,882,186; triazolyl stilbene types as illustrated in U.S. Patents 2,668,777, 2,684,966, 2,713,057, 2,784,183, 2,784,197, 2,817,665, 2,907,760, 2,927,866 and 2,993,892; stilbene cyanuric types as illustrated in U.S. Pat. Nos. 2,473,475, 2,526,668, 2,595,039, 2,618,636, 2,658,064, 2,658,065, 2,660,578, 2,666,052, 2,694,064, and 2,840,557; acylamino stilbene types as illustrated in U.S. Pat. Nos. 2,084,413, 2,468,431, 2,521,665, 2,528,323, 2,581,057, 2,623,064, 2,674,604, and 2,676,982; or miscellaneous types such as shown in U.S. Pat. Nos. 2,911,415 and 3,031,460. The amount of brightener may be for instance in the range of about 1/20% to 1%, e.g. 1/10% to 1/2%.

The encapsulated DIPA is available (as "Suprox") as a white, free-flowing odorless granular solid containing about 4% active oxygen, about 25% DIPA, about 48% $MgSO_4$ and about 27% water of hydration, with a particle size such that 98% passes through a 14 mesh sieve while 95% is retained on an 80 mesh sieve (sieved sizes are U.S. standard). A 1% solution of this encapsulated product has a pH of 5.6.

The preferred compositions of this invention contain little or no phosphates, preferably less than 1% phosphate, and preferably contain little or no enzymes, quaternary amines or chlorinating agents.

It is understood that the foregoing detailed description is given merely by way of illustration and that variations may be made therein without departing from the spirit of the invention. The "Abstract" given above is merely for the convenience of technical searchers and is not to be given any weight with respect to the scope of the invention.

I claim:

1. A fabric bleaching composition consisting essentially of stabilized diperisophthalic acid and a water-soluble nonionic detergent selected from the group consisting of (a) $C_{10}$-$C_{16}$ alkanols condensed with about 5 to 15 moles of ethylene oxide and (b) an ether of polyethylene glycol and a blend of $C_{16}$-$C_{18}$ alcohols, containing about 60% or 65% ethylene oxide the weight ratio of diperisophthalic acid to nonionic detergent being about 0.2:1 to 1:1.

2. A composition as in claim 1 containing sodium silicate and sodium carbonate.

3. A composition as in claim 1 in which said acid is encapsulated in hydrated magnesium sulfate.

4. A composition as in claim 2 in which the amounts of added alkaline materials are such that when the composition is dissolved in 1 liter of water per 150 mg of said acid the pH is in the range of about 9 to 11.

5. In the process of bleaching stained fabrics by subjecting them to a solution containing dissolved stabilized diperisophthalic acid, the improvement in which said solution is at a temperature below 90°F. and contains a watersoluble nonionic detergent selected from the group consisting of (a) $C_{10}$-$C_{16}$ alkanols condensed with about 5 to 15 moles of ethylene oxide and (b) an ether of polyethylene glycol and a blend of $C_{16}$-$C_{13}$ alcohols, containing about 60% or 65% ethylene oxide, the weight ratio of the diperisophthalic acid to nonionic detergent being about 0.2:1 to 1:1.

6. Process as in claim 5 in which the pH is in the range of about 9 to 11 and the amount of said acid dissolved in said solution is about 0.01 to 0.05%.

* * * * *